US012128286B2

(12) United States Patent
Liao et al.

(10) Patent No.: US 12,128,286 B2
(45) Date of Patent: Oct. 29, 2024

(54) ELECTRIC TREADMILL WITH SAFETY STOP FUNCTION

(71) Applicant: Johnson Health Tech. Co., Ltd., Taichung (TW)

(72) Inventors: Hung-Mao Liao, Taichung (TW); Joe Chen, Taichung (TW)

(73) Assignee: Johnson Health Tech Co., Ltd., Taichung (TW)

( * ) Notice: Subject to any disclaimer, the term of this patent is extended or adjusted under 35 U.S.C. 154(b) by 0 days.

(21) Appl. No.: 18/217,993

(22) Filed: Jul. 3, 2023

(65) Prior Publication Data

US 2023/0347228 A1 Nov. 2, 2023

Related U.S. Application Data

(63) Continuation of application No. 17/243,602, filed on Apr. 29, 2021, now Pat. No. 11,738,250.

(51) Int. Cl.

| | |
|---|---|
| ***A63B 71/00*** | (2006.01) |
| ***A63B 22/02*** | (2006.01) |
| ***A63B 24/00*** | (2006.01) |

(52) U.S. Cl.

CPC ..... *A63B 71/0054* (2013.01); *A63B 22/025* (2015.10); *A63B 24/0087* (2013.01); *A63B 2071/0081* (2013.01); *A63B 2220/833* (2013.01)

(58) Field of Classification Search

CPC ..... A63B 2071/0081; A63B 71/0054; A63B 22/02; A63B 22/025; A63B 2220/833; A63B 24/0087; A63B 2071/009

See application file for complete search history.

(56) References Cited

U.S. PATENT DOCUMENTS

| | | | | |
|---|---|---|---|---|
| 6,786,853 | B2 * | 9/2004 | Wu | A63B 22/0257 482/54 |
| 2010/0216599 | A1 * | 8/2010 | Watterson | A63B 71/0622 482/52 |
| 2018/0243611 | A1 * | 8/2018 | Bradley | A63B 71/0054 |

FOREIGN PATENT DOCUMENTS

WO WO-2020246646 A1 * 12/2020

OTHER PUBLICATIONS

English Translation of Lee WO2020246646A1 (Year: 2020).*

* cited by examiner

*Primary Examiner* — Loan B Jimenez
*Assistant Examiner* — Sara K. Conway

(57) ABSTRACT

A motorized treadmill includes a base, an endless belt movable relative to the base for allowing a user to exercise thereon, a motor coupled to the endless belt for driving the endless belt to rotate, a retaining mechanism and a controller in communication with the motor. The retaining mechanism has a retaining member mounted at a rear end of the base under the endless belt and a sensor coupled to the retaining member. The sensor is configured to sense whether an object contacts the retaining member. The controller is configured to determine whether rotation of the endless belt is interfered by the object. When the sensor detects that the retaining member comes into contact with the object, the controller determines that the endless belt is interfered by the object and stops rotation of the motor to slow down or stop rotation of the endless belt.

19 Claims, 9 Drawing Sheets

ELECTRIC TREADMILL WITH SAFETY STOP FUNCTION

CROSS-REFERENCE TO RELATED APPLICATION

This is a continuation of application Ser. No. 17/243,602, filed Apr. 29, 2021.

BACKGROUND

1. Field of the Invention

The present invention relates to an electric treadmill. More particularly, the present invention relates to a motorized treadmill having a safety stop function.

2. Description of the Related Art

Indoor exercise is becoming more and more popular these days. Many people are becoming aware of the need to exercise in order to maintain or improve their health and fitness. Since a person's schedule, weather, or other factors may prohibit the person from exercising outdoors, it is more convenient for the person to exercise indoors. Accordingly, indoor exercise apparatuses such as treadmills, stair exerciser apparatuses, steppers and exercise bikes provide such advantages for the person to use.

In general, since the exercise apparatuses are used in confined spaces, such as in a user's living space, in a gymnasium or other training facilities, other persons or objects are often present in the same place as the exercise apparatus. If a foreign object approaches too close to an exercise apparatus that is in use, the exercise apparatus and/or the object may de damaged. For example, when an adult uses an electric treadmill at home, children or pets may also be present in the same place. Once the child or pet comes near the electric treadmill and touches the treadmill belt while the treadmill belt is running, the child or pet may be pulled, pinned or entrapped under the electric treadmill.

The present invention has arisen to mitigate and/or obviate the disadvantages of exercise apparatuses. Further benefits and advantages of the present invention will become apparent after a careful reading of the detailed description with appropriate reference to the accompanying drawings.

SUMMARY

The present invention is directed to a motorized treadmill. When the motorized treadmill detects that rotation of the endless belt is interfered by objects or children, the motorized treadmill is operable to stop operation of the motor to slow or stop rotation of the endless belt.

According to one aspect of the present invention, a motorized treadmill includes a base, an endless belt movable relative to the base for allowing a user to exercise thereon, a motor coupled to the endless belt for driving the endless belt to rotate, a retaining mechanism, and a controller in communication with the motor and the retaining mechanism. The retaining mechanism has a retaining member mounted at a rear end of the base. The retaining member is configured to prevent an object from entering the bottom of the base. The controller is configured to determine whether rotation of the endless belt is interfered by the object. When the retaining member comes into contact with the object, the controller determines that the endless belt is interfered by the object and stops rotation of the motor to slow down or stop rotation of the endless belt.

Preferably, the retaining mechanism has a sensor coupled to the retaining member for sensing a force applied to the retaining member and transmitting an electrical signal to the controller. When the sensor senses a force applied to the retaining member, the controller determines that the endless belt is interfered by the object and stops rotation of the endless belt.

Preferably, when the controller determines that the endless belt is interfered by the object, the controller is operable to shut off power to the motor to stop operation of the motor for slowing down or stopping rotation of the endless belt.

Preferably, the motorized treadmill further defines an unsafe zone between the base and a ground at the rear end of the base. The retaining member is located in the unsafe zone. When the object is entrapped into the unsafe zone by rotation of the endless belt, the object will be retained by the retaining member and the controller is operable to stop rotation of the motor to slow down or stop rotation of the endless belt.

Preferably, the base has a front roller and a rear roller, and the endless belt is mounted around the front roller and the rear roller. The endless belt defines an upper run at a top of the base for allowing the user to exercise thereon and a lower run at a bottom of the base. The retaining member is located near the rear roller and below the lower run of the endless belt to prevent the object from being stuck under the rear roller.

Further benefits and advantages of the present invention will become apparent after a careful reading of the detailed description with appropriate reference to the accompanying drawings.

DETAIL DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically depicted in order to simplify the drawings.

An exercise apparatus configured to sense objects or children and respond to the objects or children when the exercise apparatus is interfered by the objects or children is provided. The exercise apparatus is a treadmill having a running belt for allowing a user to do exercises of walking, jogging or running thereon. The treadmill is an electric treadmill or a motorized treadmill. The treadmill has a sensor configured to sense objects other than the user who is operating the treadmill, such that when the running belt of the treadmill is interfered by a foreign object or a child, the treadmill is able to stop rotation of the running belt in order to prevent the object from being pulled under the treadmill.

Figure 1:
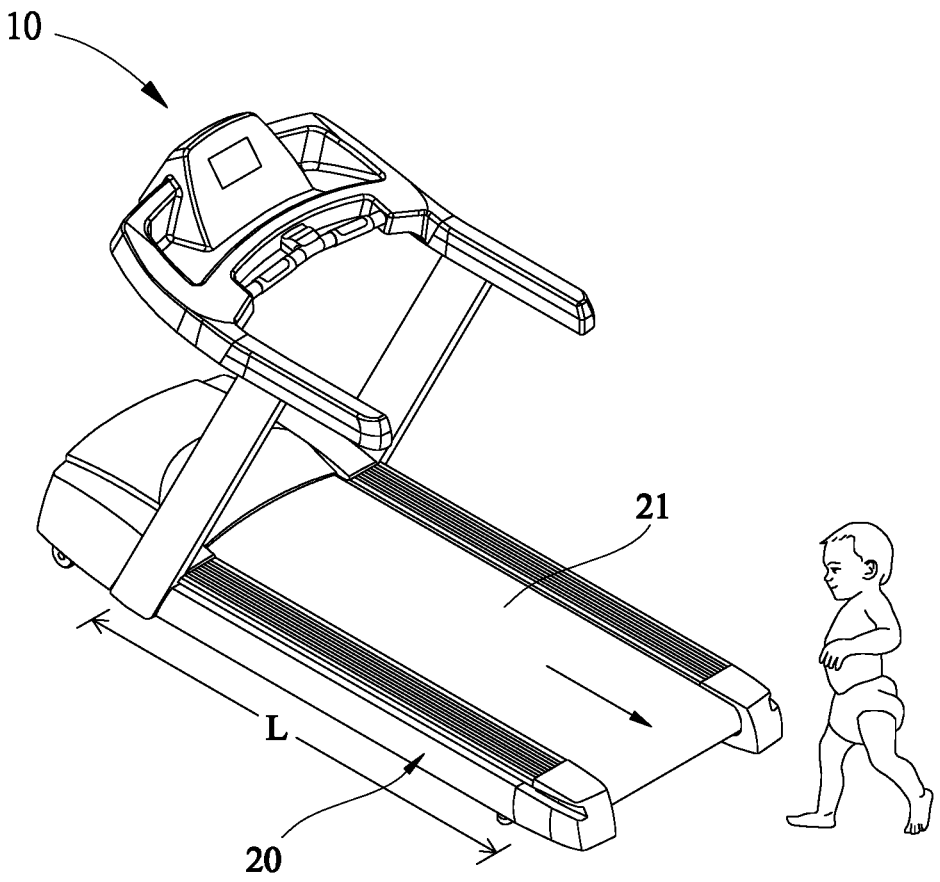
FIG. 1 is a perspective view of a motorized treadmill in accordance with a first preferred embodiment of the present invention, showing a child approaching the motorized treadmill.
Figure 2:
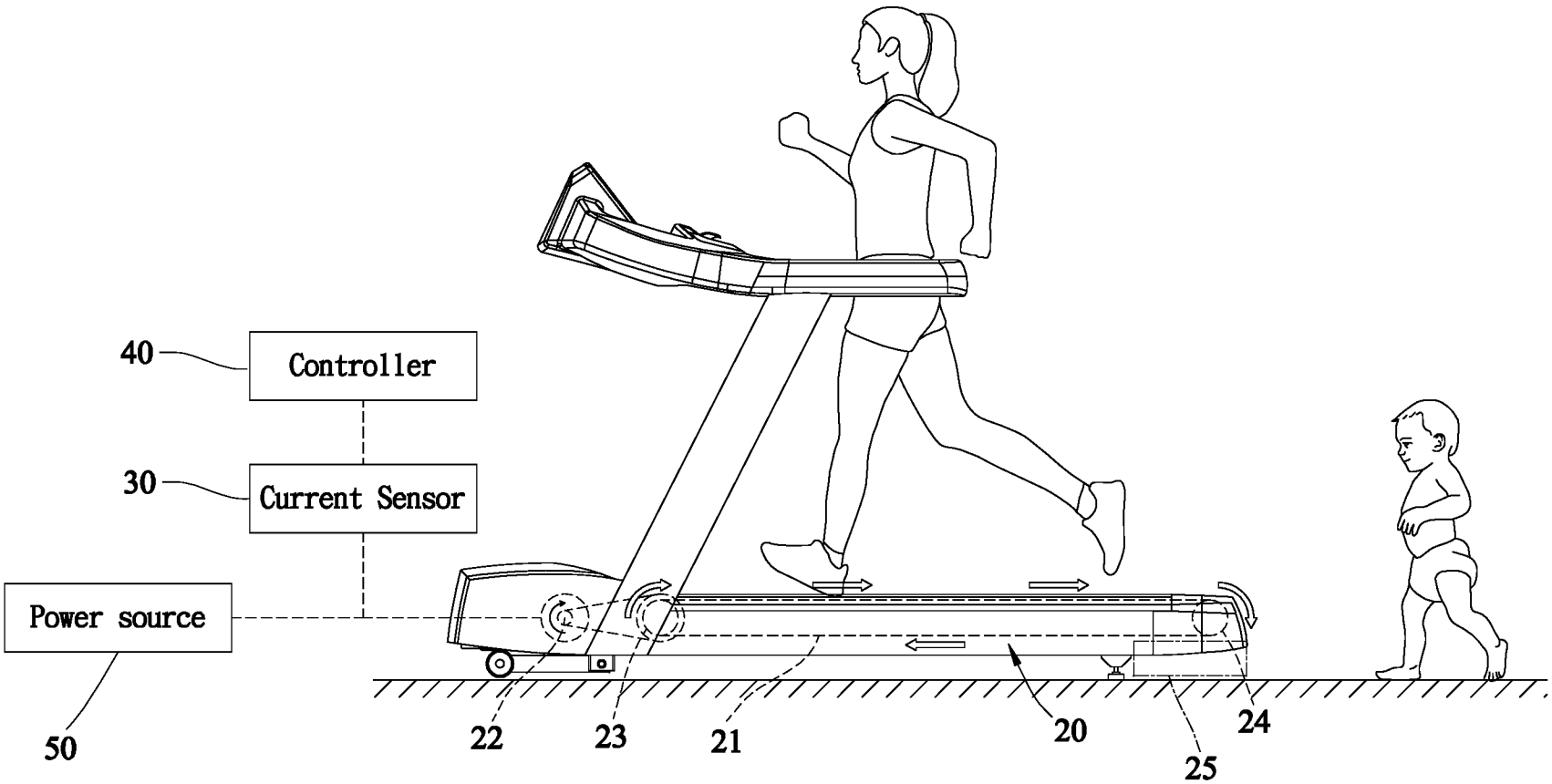
FIG. 2 is a side view of the first preferred embodiment of the present invention.

Referring to FIG. 1 and FIG. 2, a motorized treadmill 10 is illustrated in accordance with a first preferred embodiment of the present invention. The motorized treadmill 10 includes a base 20 rested on the ground, an endless belt 21 movable relative to the base 20, a motor 22 coupled to the endless belt 21 for driving the endless belt 21 to rotate, a current sensor 30 and a controller 40 in communication with the motor 22 and the current sensor 30.

As shown in FIG. 2, the base 20 has a frame, a front roller 23 and a rear roller 24 disposed parallel on a front end and a rear end of the frame of the base 20, and the endless belt 21 is mounted around the front roller 23 and the rear roller 24. The upper surface of the endless belt 21 forms an exercise surface which is slidable in a longitudinal direction for supporting a user and allowing the user to do exercises of walking, jogging or running thereon. The motor 22 is mounted on the frame of the base for driving movement of the endless belt 21. In the preferred embodiment of the present invention, the motor 22 is disposed at the front end of the base 20 and structurally coupled to the front roller 23 for driving the endless belt 21 to rotate. The motor 22 is electrically connected to a power source 50, such as an AC power or a DC power, via a wire. The power source 50 transmits an input current into the motor 22 via the wire so as to power the motor 22 to drive the endless belt 21. In the first preferred embodiment of the present invention, the motorized treadmill 10 has a current sensor 30 associated with the motor 22 by being positioned between the motor 22 and the power source 50. The current sensor 30 is configured to detect a motor current of the motor 22 namely the input current into the motor 22, and generate a current signal proportional to the motor current or the input current. The detail of the current sensor 30, such as how to detect electrical current in a wire or generate a signal, is well-known and will not be further described here. The motor 22 of the present invention can be a DC motor or an AC motor, which is not limited in the present invention.

The controller 40 is operable to receive data according to operation of the motor 22, and further operable to process the data. In the illustrated embodiment, the controller 40 includes a microcontroller unit, at least one electronic circuit, and at least one circuit board. The microcontroller unit and the electronic circuit are assembled on the circuit board to form a controller assembly. In other embodiments, the controller 40 can be a computer processing system that includes a hardware assembly, a software assembly, and/or a firmware assembly. The hardware assembly of the controller 40 can include a processor that is in communication with a computer readable storage medium. The computer readable storage medium can be any suitable data storage device that can store data that can be thereafter accessed and read by the controller (or components thereof) or a separate computing system. Examples of computer readable storage medium can include, but is not limited to, read-only memory, CD-ROM, CD-R, CD-RW, DVD, DVD-RW, magnetic tapes, Universal Serial Bus (USB) flash drive, or any other optical or other suitable data storage device.

In operation, the current signal is transmitted from the current sensor 30 to the controller 40. Consequently, the controller 40 can continue to monitor a state of the motor current. If a user gets on the endless belt 21 during operation of the motor 22, the motor 22 will draw more current since the endless belt 21 undertakes the user footfall and needs more driving power from the motor 22 to keep regular operating. Therefore, the current sensor 30 will detect a current change of the motor current that is caused by the user footfall. Thereafter, the current sensor 30 transmits the current signal proportional to the motor current to the controller 40, so that the controller 40 can determine, via the current signal, whether the user is engaging the endless belt 21. In other situation, if rotation of the endless belt 21 is interfered by objects or children during operation of the motor 22, the current sensor 30 will also detect a current change of the motor current that is caused by interference of the objects or children other than the user of the motorized treadmill 10. Therefore, the controller 40 can determine, via the current signal, whether an object or a child gets caught in the endless belt 21 namely being pulled by the endless 21 under the motorized treadmill 10. If the controller 40 determines that an object or a child gets caught in the endless belt 21, the controller 40 is operable to stop rotation of the endless belt 21 immediately, e.g. power off the motorized treadmill 10 to slow or stop rotation of the endless belt 21.

Referring to FIG. 2, when the endless belt 21 is driven by the motor 22, the current sensor 30 is operable to detect the input current in the wire to the motor 22 (hereinafter the motor current) to detect whether the motorized treadmill 10 is used by a user and detect whether the endless belt 21 is interfered by objects or children other than the user, and generate a current signal proportional to the motor current. The current signal is transmitted from the current sensor to the controller 40, and the controller 40 can be programed to analyze fluctuations in the motor current to determine that current changes of the motor current of the motor 22 are caused by a user who is using the motorized treadmill 10, or a foreign object (e.g., a ball or a pet such as a dog), or a child. Fluctuations occur when a user is using the motorized treadmill 10 due to the user's foot contacting the endless belt 21 and briefly causing a change in resistance to movement of the endless belt 21, or occur when a foreign object or a child contacts the endless belt 21 and causing a change in resistance to movement of the endless belt 21. The controller 40 can be programed to analyze the amplitude and frequency of the fluctuations to determine whether or not a user is using the motorized treadmill 10. Specifically, in the preferred embodiment of the present invention, the controller 40 can be programed to determine whether a foreign object or a child unexpectedly interrupts rotation of the endless belt 21.

Figure 3:
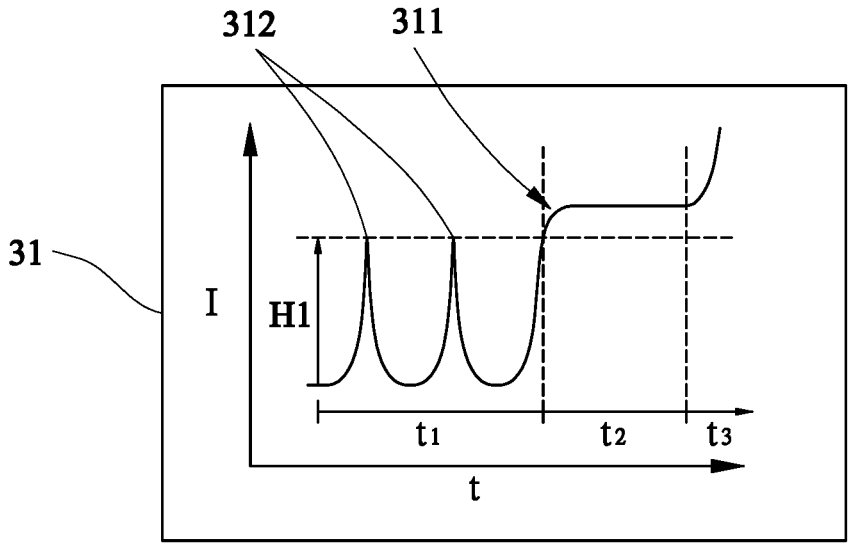
FIGS. 3-4 illustrate plots of current versus time for showing changes of the motor current during operation of the motor.
Figure 4:
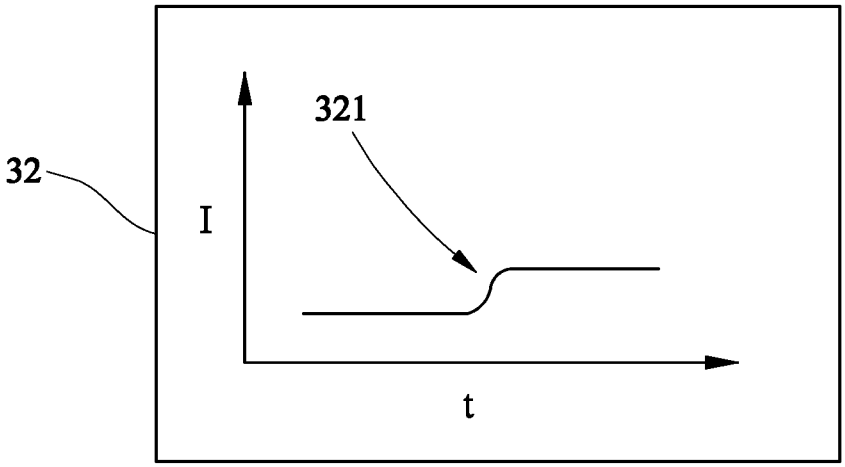

For example, when a user is using the motorized treadmill 10 to perform exercises of walking, jogging or running on the endless belt 21, the motor current detected by the current sensor 30 may be changed periodically due to periodic foot impacts on the endless belt 21. If the current sensor 30 detects a current change associated with other than the user of the motorized treadmill 10, the controller 40 can determine that the endless belt 21 may be interrupted by objects or children. FIG. 3 and FIG. 4 illustrate plots 31, 32 of current versus time for showing changes of the motor current during operation of the motor 22. As shown in FIG. 3, the plot 31 illustrates that the user is walking, jogging or running on the endless belt 21 initially and an unexpected current increase 311 of the motor current occurs while the endless belt 21 is still running. When the current sensor 30 detects the unexpected current increase 311, the controller 40 determines that the rotation of the endless belt 21 may be interfered by objects or children, and then stop rotation of the endless belt 21 immediately. In another condition, as shown in FIG. 4, the plot 32 illustrates that the endless belt 21 is driven by the motor 22 without any user thereon so that the motor current to the motor 22 does not have any pulse initially, and then an unexpected current increase 321 of the motor current occurs while the endless belt 21 is running. When the current sensor 30 detects the unexpected current increase 321, the controller 40 determines that the rotation of the endless belt 21 may be interfered by objects or children other than the user, and then stop rotation of the endless belt 21 immediately.

During rotation of the endless belt 21, the current sensor 30 is operable to detect current changes of the motor current such as current pulses associated with the periodic contact of a user's foot with the endless belt 21 and generate a current signal transmitted to the controller 40. FIG. 3 illustrates fluctuations of the motor current of the motor 22 in a condition where a user is performing walking, jogging or running on the endless belt 21. The controller 40 is able to determine whether or not the current change is caused by the footfall of the user according to the current signal transmitted from the current sensor 30. When the controller 40 determines that the current change of the motor current of the motor 22 is not caused by the footfall of the user, the controller 40 can determine that the endless belt 21 is interfered by foreign objects or children and control the motor 22 to stop rotation of the endless belt 21. For example, as shown in FIG. 3 and referring to FIG. 2, when a user runs on the endless belt 21 of the motorized treadmill 10, the current sensor 30 will detect a plurality of current pulses 312 as shown in plot 31. Each of the current pulses 312 represents one footfall of the user on the endless belt 21 and each current pulse 312 has a current amplitude H1 as a threshold amplitude. Specifically, the threshold amplitude is greater than a maximum amplitude caused by the user's foot impacts on the endless belt. When the current sensor 30 detects a current increase 311 in the motor current of the motor 22 exceeding the current amplitude H1 and continuing for a predetermined period of time, namely the motor current is continuously increased for a while, the controller 40 can determine that endless belt 21 is interfered by objects or children and stops rotation of the endless belt 21 so as to prevent the objects or children from being pulled under the motorized treadmill 10.

FIG. 4 illustrates fluctuations of the motor current of the motor 22 in another condition where the endless belt 21 is rotating without any user thereon, as depicted in FIG. 1, namely the motor 22 is powered to drive the endless belt 21 without a user using it. When the current sensor 30 detects a current change of the motor current, the controller 40 is able to determine that the current change is caused by footfall of the user or a foreign object or a child according to the fluctuations of the motor current. For example, as shown in FIG. 4, when the current sensor 30 detects that a current increase 321 in the motor current into the motor 22 is continuous for a predetermined period of time, namely the motor current is continuously increased for a while, the controller 40 can determine that the endless belt 21 is interfered by objects or children other than the user and stops rotation of the endless belt 21 so as to prevent the objects or children from being pulled under the motorized treadmill 10.

Back referring to FIG. 2, the motorized treadmill 10 defines an unsafe zone between the base 20 and the ground at the rear end of the base 20 under the rear roller 24. More specifically, the unsafe zone 25 is defined between the endless belt 21 and the ground. If an object or limbs of a child gets into the unsafe zone 25, the object or the child may be pulled, pinned and entrapped under the rear roller 24 of the motorized treadmill 10 due to the rotation of the endless belt 21. In general, the rear end of the base 20 of the motorized treadmill 10 has no shield or frame, as shown in FIG. 1. Therefore, when a foreign object or a child approaches the rear end of the motorized treadmill 10 and contacts the endless belt 21 while the endless belt 21 is rotating, the foreign object or child may be pulled by the endless belt 21 and get stuck. In order to prevent this accident, the motorized treadmill 10 has to be provided with a safety mechanism. In the first preferred embodiment of the present invention, the current sensor 30 is provided for detecting current changes of the motor current and transmitting the current signal to the controller 40, so that the controller 40 can be programed to analyze fluctuations of the motor current to determine whether a foreign object or child gets into the unsafe zone 25. When a foreign object or a child gets stuck in the unsafe zone 25, the current sensor 30 will detect an abnormal current increase of the motor current of the motor 22, and then the controller 40 is operable to power off the motorized treadmill 10 namely interrupt the power source 50 transmitting power to the motor 22 to stop operation of the motor 22 so as to slow or stop rotation of the endless belt 21 for preventing the object or child from being further pulled under the motorized treadmill 10.

In the preferred embodiment of the present invention, as shown in FIG. 3, the current sensor 30 detects an abnormal current increase 311 in the motor current continuing for a predetermined period of time, if the controller 40 determines that the current increase 311 is not caused by the user's footfall (e.g. the current pulses 312 shown in plot 31), the controller 40 can determine that a foreign object or a child may get stuck under the rear roller 24 and the rotation of the endless belt 21 is interfered by the foreign object or the child. Therefore, the controller 40 is operable to cut off the power supply to the motor 22 immediately to slow or stop rotation of the endless belt 21. Referring to FIG. 3, the plot 31 defines a first time interval t1, a second time interval t2, and a third time interval t3 during operation of the motor 22. The first time interval t1 ends before the current sensor 30 detects an abnormal current increase 311 or 321, namely ends before the time the endless belt 21 is interfered by a foreign object or a child. The second time interval t2 is defined between the time the endless belt 21 is interfered by the foreign object or the child and the time the rotation of the endless belt 21 is stopped because it gets stuck by the foreign object or the child. The third time interval t3 represents the time after the time the rotation of the endless belt 21 is completely stopped.

The controller 40 is operable to cut off the power to the motor 22 when the current sensor 30 detects a current increase 311 in the motor current and the current increase has occurred continuously for a predetermined period of time. The predetermined period of time is defined within the second time interval t2, namely the predetermined period of time is not longer than the second time interval t2. In the preferred embodiment of the present invention, when the current sensor 30 detects that the endless belt 21 is interfered by objects or children, the controller 40 is programed to stop operation of the motor 22 before the objects or children get stuck under the motorized treadmill 10. Referring to FIG. 3, when a foreign object continuously contacts the endless belt 21, the current sensor 30 may detect that the motor current is kept at a relative high value for a while (e.g. the current change of the motor current in the second time interval t2) rather than the current pulses caused by the user's footfall (e.g. the current change of the motor current in the first time interval t1), so that the controller 40 can determine that the endless belt 21 may be interfered by a foreign object or a child according to fluctuations of the motor current. Specifically, referring to FIG. 1 and FIG. 2, the endless belt 21 of the motorized treadmill 10 defines a longitudinal length L between the front roller 22 and the rear roller 24. The aforementioned predetermined period of time is defined as the longitudinal length L of the endless belt 21 divided by a running speed of the endless belt 21. For example, when the longitudinal length L of the endless belt 21 is 150 cm and the running speed of the endless belt is 9 km/h, the predetermined period of time is set to 0.6 s, namely when the endless belt is running at 9 km/h and the current sensor 30 detects that the motor current is kept at a relative high value over 0.6 s, the controller 40 can determine that the endless belt 21 is interfered by objects or children other than the user and is operable to stop operation of the motor 22 to slow or stop rotation of the endless belt 21.

Figure 5:
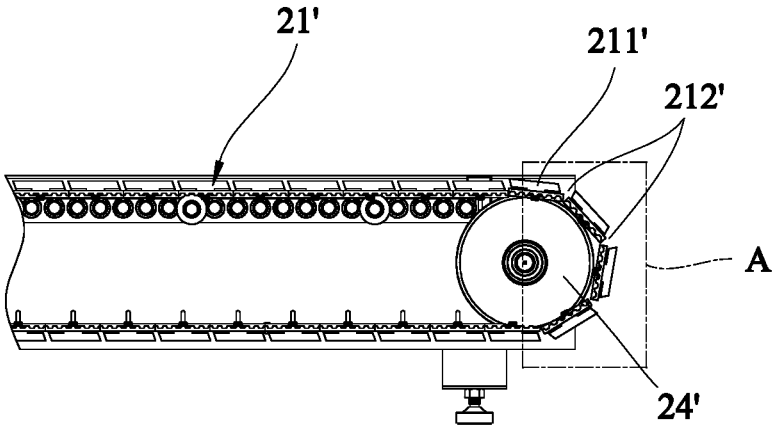
FIG. 5 illustrates that the endless belt of the motorized treadmill is a slat belt.
Figure 6:
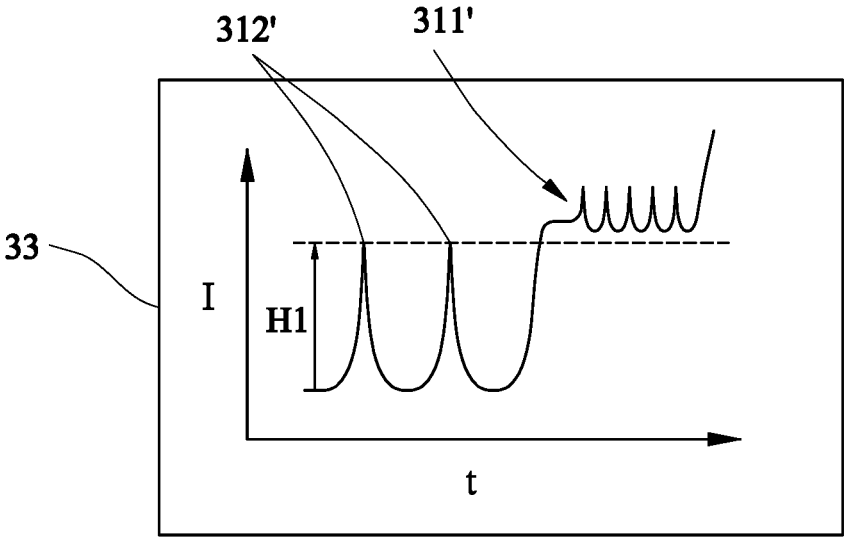
FIG. 6 illustrates a plot of current versus time for showing changes of the motor current during operation of the motor for the slat-belt treadmill shown in FIG. 5.

Referring to FIG. 5, the motorized treadmill could be a slat-belt treadmill having a slat belt 21'. The slat belt 21' is constituted by a plurality of slats 211' attached to each other to form an endless belt. The slats 211' themselves can be fabricated from plastic, rubber, wood, etc. Every adjacent two of the slats 211' of the slat belt 21 'are spaced apart with a gap 212' therebetween. In general, during rotation of the slat belt 21', the gaps 212' at the rear end of the slat-belt treadmill near the rear roller 24' as indicated in the region A are larger than the gaps 212' at the upper run or the lower run of the slat belt 21'. FIG. 6 illustrates a plot 33 of current versus time for showing changes of the motor current during operation of the motor for the slat-belt treadmill while a user is using the slat-belt treadmill. The plot 33 illustrates that a current sensor detects a current interference 311' of the motor current which is not caused by the user's footfalls (as the current pulses 312' shown in the plot 33). When detecting the current interference 311' of the motor current, a controller is operable to determine that the rotation of the slat belt 21' may be interfered by object or children, and then cut off the power to the motor to slow or stop rotation of the slat belt 21'. As shown in FIG. 6, the current interference 311' is caused by rotation of the slats 211' contacting a foreign object or a child. Since every adjacent two slats 211' are spaced apart with a gap 212' and the gaps 212' are enlarged at the rear roller 24', so that the slats 211' may contact the foreign object or child intermittently and causing the current change of the motor current increased intermittently. For the slat-belt treadmill, the current interference 311' generally has a higher frequency than a stride frequency of the user.

Figure 7:
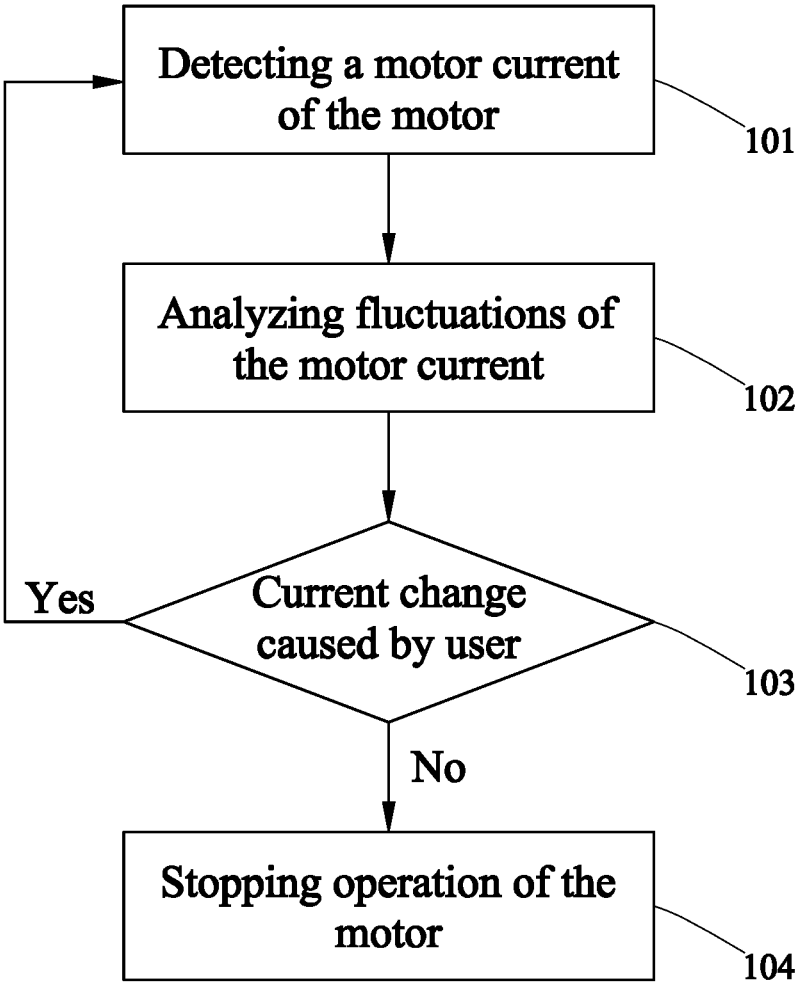
FIG. 7 is a flow diagram showing one possible operation of the motorized treadmill of FIG. 1.

FIG. 7 illustrates an example of a method for determining whether a motorized treadmill 10 is interfered by objects or children. The motorized treadmill 10 having an endless belt 21 and a motor 22 coupled to the endless belt 21 for driving the endless belt 21 to rotate. The motor 22 can be controlled by a controller 40. The controller 40 is operable to determine whether the rotation of the endless belt 21 is interfered by objects or children other than the user of the motorized treadmill 10.

At step 101, the motorized treadmill 10 is powered on and in an operational state, namely the motor 22 is powered to drive the endless belt 21. The motorized treadmill 10 detects a motor current of the motor 22 via a current sensor 30 while the endless belt 21 is rotating.

Next, at step 102, the controller 40 receives the current signal transmitted from the current sensor 30 and analyzes fluctuations of the motor current according to the current signal.

At step 103, the controller 40 is programed to determine whether a current change of the motor current is caused by a user who is using the motorized treadmill 10. For example, the controller 40 can compare the received data from the current sensor 30 to a known (or default or standard) data parameter that is indicative of a user using the motorized treadmill 10. The known data parameter can be preprogramed into the controller 40, or recognized during operational use. For example, the controller 40 can determine that the current change is caused by objects or children when the current sensor 30 detects an abnormal current increase in the motor current continuing for a predetermined period of time rather than current pulses caused by the user's footfalls. If the analysis result in the step 103 is "yes", the motor 22 continues to operate, and the process returns to step 101 and repeats. If the analysis result in the step 103 is "no", the motor 22 does not continue to operate, as step 104. At step 104, the controller 40 determines that the endless belt 21 is interfered by objects or children other than the user and is operable to cut off the power to the motor 22 to slow or stop rotation of the endless belt 21.

Figure 8:
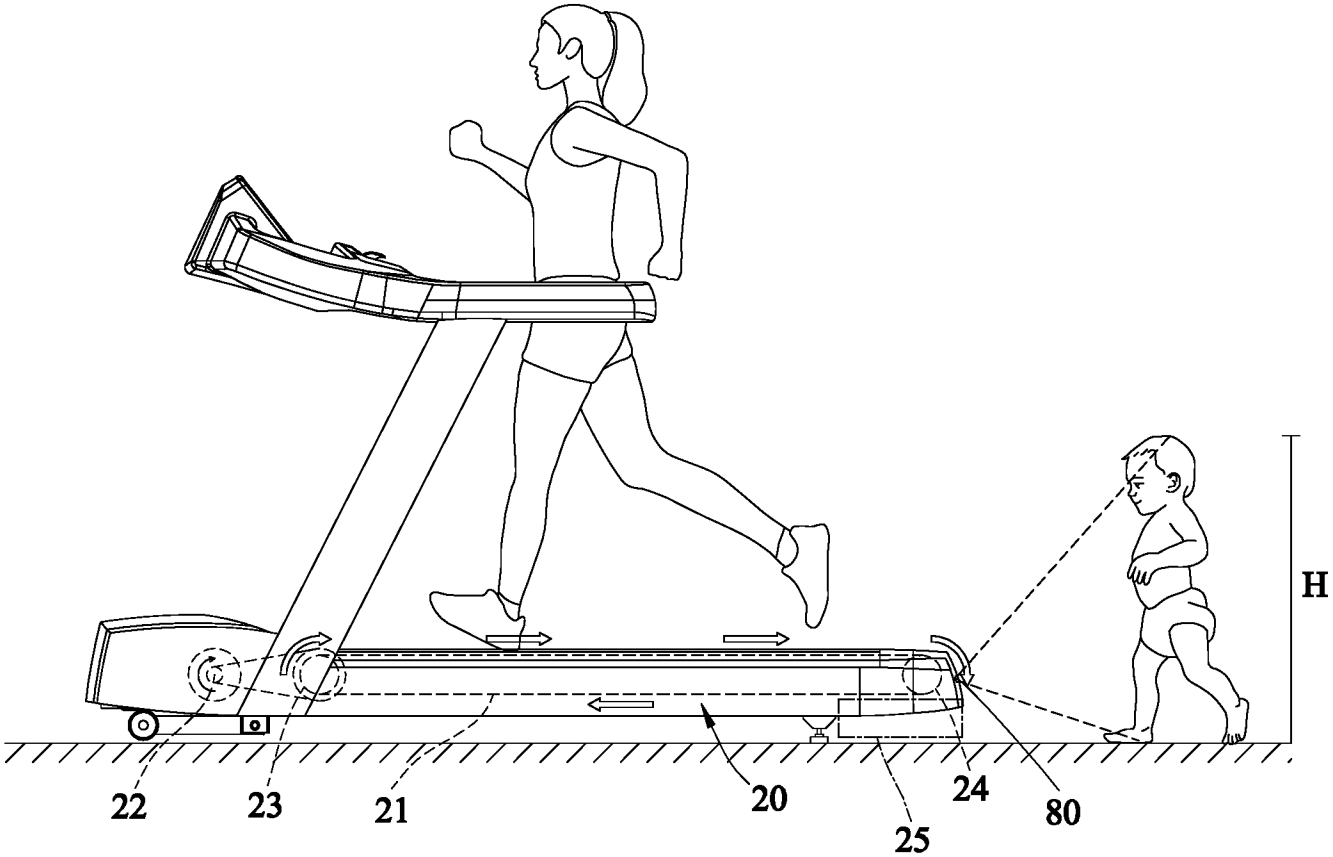
FIG. 8 is a side view of a second preferred embodiment of the present invention.

FIG. 8 illustrates a second preferred embodiment of the present invention. The second preferred embodiment is similar to the first preferred embodiment, except that the motorized treadmill 10 has an optical sensor 80 (such as a camera, infrared sensor, ultrasonic sensor, or thermal sensor) in communication with the controller 40. The optical sensor 80 is an identification device configured for identifying the height of a person or an object approaching to the motorized treadmill 10, especially to the rear roller 24. The optical sensor 80 can be disposed on the rear side of the base 20, which is not limited in the present invention. For example, when the controller 40 determines that the motorized treadmill 10 is used by children rather than adults (for instance with a height less than 120 cm) or a child approaches too close to the motorized treadmill 10 (e.g. about 30-50 cm away from the motorized treadmill 10), the controller 40 is operable to cut off the power to the motor 22 to slow or stop rotation of the endless belt 21. Moreover, it is unsafe, particularly when a child approaches too close to the rear roller 24 of the motorized treadmill 10. If a child touches the endless belt 21 at the rear roller 24, the child may get stuck in the unsafe zone 25 since the child may be pulled by the endless belt 21 while the endless belt 21 is rotating. Therefore, when the optical sensor 80 senses a foreign object or a child with a height less than a predetermined height approaching too close to the motorized treadmill 10 especially the rear of the motorized treadmill 10, the controller 40 can be programed to cut off the power to the motor 22 to slow or stop rotation of the endless belt 21 for preventing the object or child from being pulled, pinned or entrapped under the rear roller 24 of the motorized treadmill 10.

Figure 9:
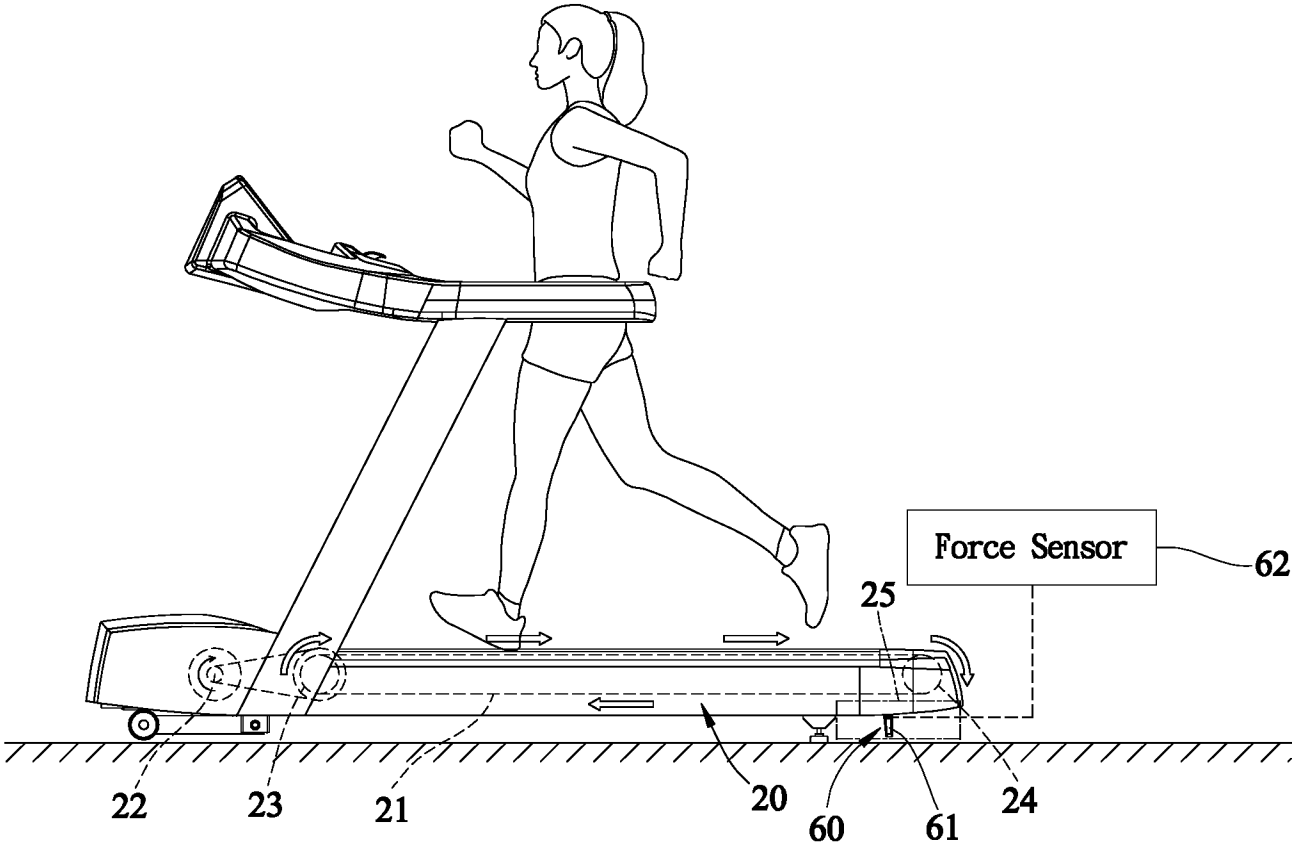
FIG. 9 is a side view of a third preferred embodiment of the present invention.

FIG. 9 illustrates a third preferred embodiment of the present invention. The third preferred embodiment is similar to the first preferred embodiment, except that the motorized treadmill 10 is provided with a retaining mechanism 60 at the bottom of the base 20. The retaining mechanism 60 has a retaining member 61 mounted on the bottom of the base 20 near the rear roller 24, namely the retaining member 61 is disposed in the aforementioned unsafe zone 25. The retaining member 61 is configured to prevent objects or children from being pulled, pinned or entrapped under the rear roller 24 of the motorized treadmill 10 due to the rotation of the endless belt 21. In the preferred embodiment, the retaining mechanism 60 has a force sensor 62 coupled to the retaining member 61 for sensing a force applied to the retaining member 61 and transmitting an electrical signal to the controller 40. The force sensor 62 may be any type of sensor known in the art that is capable of detecting a force applied to the retaining member 61, such as a pressure sensor, strain gauge, load cell, microswitch, or any combination thereof. For example, if an object or a child is pulled, pinned or entrapped into the unsafe zone 25 by the endless belt 21, the object or child may be retained by the retaining member 61 such that the retaining member 61 is forced by the object or child and the force sensor 62 will sense a force applied to the retaining member 61. When the force sensor 62 senses a force applied to the retaining member 61, the controller 40 determines that a foreign object or a child gets stuck under the rear roller 24 and stops operation of the motor 22 to slow or stop rotation of the endless belt 21.

Figure 10:
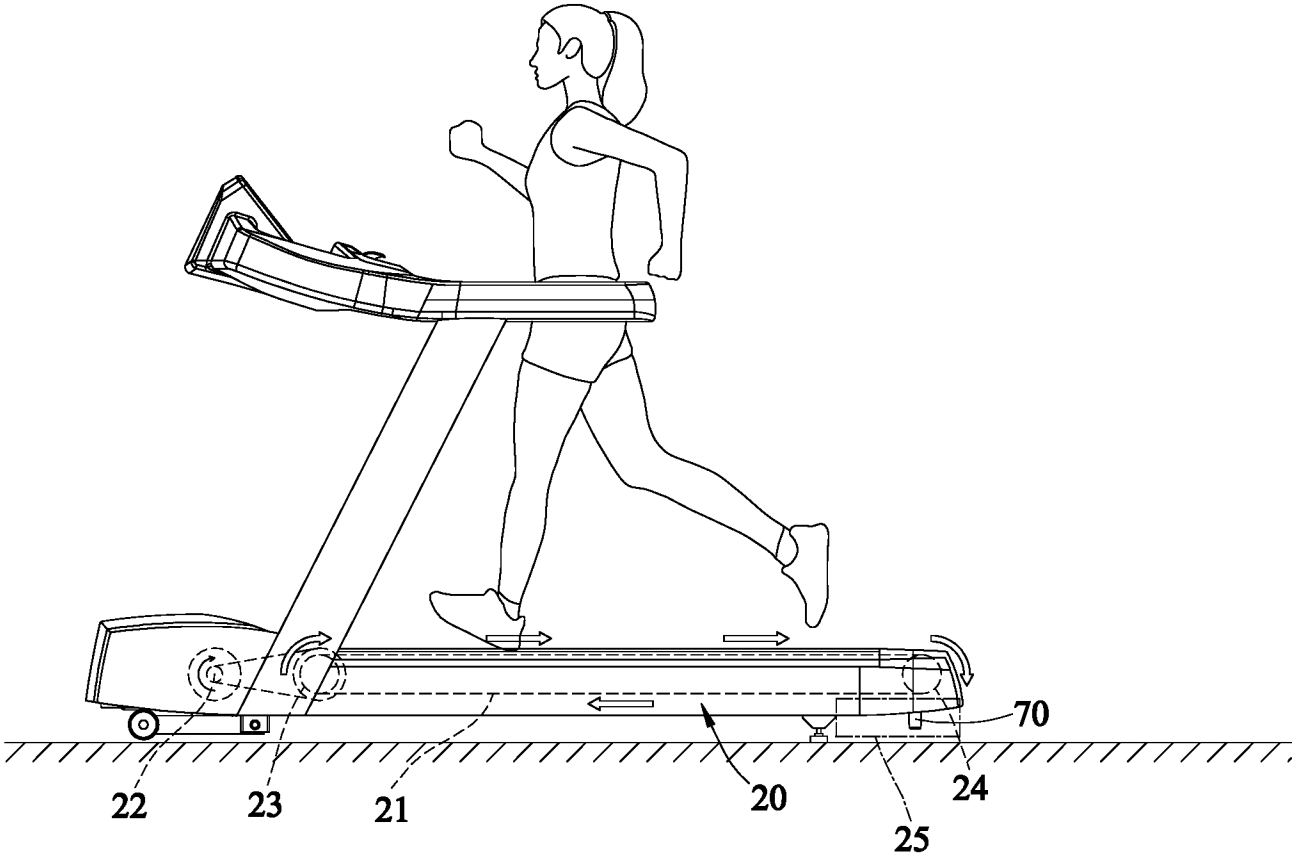
FIG. 10 is a side view of a forth fourth preferred embodiment of the present invention.
Figure 11:
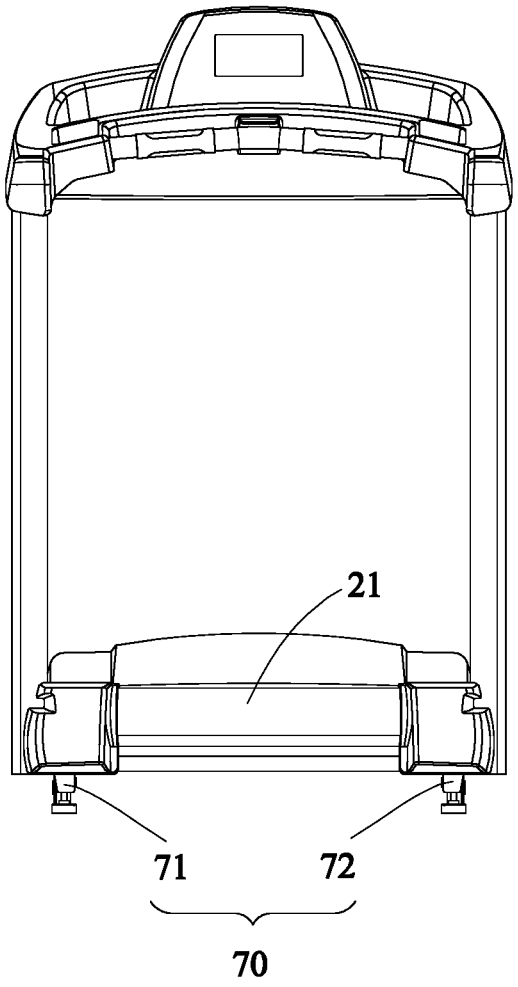
FIG. 11 is a rear view of the motorized treadmill shown in FIG. 10.

FIG. 10 illustrates a forth preferred embodiment of the present invention. The forth preferred embodiment is similar to the first preferred embodiment, except that the motorized treadmill 10 is provided with an infrared sensor 70 at the bottom of the base 20 under the rear roller 24. The infrared sensor 70 is disposed in the aforementioned unsafe zone 25 for sensing whether a foreign object or a child get into the unsafe zone 25 and transmitting an electrical signal to the controller 40. When the infrared sensor 70 senses objects or children into the unsafe zone 25, the controller 40 is operable to stop operation of the motor 22 to slow or stop rotation of the endless belt 21. Referring to FIG. 11, the infrared sensor 70 generally includes a transmitter module 71 and a receiver module 72 disposed opposite to each other. For example, the transmitter module 71 can be mounted on the bottom of the left side of the base 20 and the receiver module 72 can be mounted on the bottom of the right side of the base 20. The transmitter module 71 is configured to transmit infrared and the receiver module 72 is configured to receive the infrared transmitted from the transmitter module 71. When the infrared transmitted from the transmitter module 71 to the receiver module 72 is blocked, the controller 40 can determine that a foreign object or a child may get stuck under the rear roller 24 and stops operation of the motor 22 to slow or stop rotation of the endless belt 21.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A motorized treadmill, comprising:

a base;

an endless belt movable relative to the base for allowing a user to exercise thereon;

a motor coupled to the endless belt for driving the endless belt to rotate;

a retaining mechanism having a retaining member mounted at a rear end of the base, the retaining member configured to prevent an object from entering a bottom of the base; and a controller in communication with the motor and the retaining mechanism, the controller configured to determine whether rotation of the endless belt is interfered by the object;

wherein when the object comes into contact with the retaining member, the controller determines that the endless belt is interfered by the object and stops rotation of the motor to slow down or stop rotation of the endless belt.

2. The motorized treadmill as claimed in claim 1, wherein the retaining mechanism has a sensor coupled to the retaining member for sensing a force applied to the retaining member and transmitting an electrical signal to the controller; and wherein when the sensor senses the force applied to the retaining member, the controller determines that the endless belt is interfered by the object and stops rotation of the endless belt.

3. The motorized treadmill as claimed in claim 1, wherein when the controller determines that the endless belt is interfered by the object, the controller is operable to shut off power to the motor to stop operation of the motor for slowing down or stopping rotation of the endless belt.

4. The motorized treadmill as claimed in claim 1, further defines an unsafe zone between the base and a ground at the rear end of the base, wherein the retaining member is located in the unsafe zone; and wherein when the object is entrapped in the unsafe zone by rotation of the endless belt, the object will be retained by the retaining member and the controller is operable to stop rotation of the motor to slow down or stop rotation of the endless belt.

5. The motorized treadmill as claimed in claim 1, wherein the base has a front roller and a rear roller, the endless belt mounted around the front roller and the rear roller, the retaining member being located near the rear roller to prevent the object from being struck stuck under the rear roller.

6. The motorized treadmill as claimed in claim 5, further defines an unsafe zone between the base and a ground under the rear roller of the base, wherein the retaining member is located in the unsafe zone; and wherein when the object is entrapped in the unsafe zone by rotation of the endless belt, the object will be retained by the retaining member and the controller is operable to stop rotation of the motor to slow down or stop rotation of the endless belt.

7. The motorized treadmill as claimed in claim 1, wherein the endless belt is a slat belt mounted around the base, the slat belt being constituted by a plurality of slats.

8. The motorized treadmill as claimed in claim 1, wherein the endless belt defines an upper run at a top of the base and a lower run at the bottom of the base, the upper run of the endless belt configured for allowing the user to exercise thereon, and wherein the retaining member is located below the lower run of the endless belt at the rear end of the base to prevent the object from being stuck under the lower run of the endless belt.

9. A motorized treadmill, comprising:

a base rested on a ground;

an endless belt mounted around the base for allowing a user to exercise thereon;

a motor coupled to the endless belt for driving the endless belt to rotate;

a retaining mechanism having a retaining member mounted at a rear end of the base under the endless belt and a sensor coupled to the retaining member, the sensor configured to sense whether an object contacts the retaining member; and a controller in communication with the motor and the sensor of the retaining mechanism, the controller configured to determine whether rotation of the endless belt is interfered by the object;

wherein when the sensor detects that the object comes into contact with the retaining member, the controller determines that the endless belt is interfered by the object and stops rotation of the motor to slow down or stop rotation of the endless belt.

10. The motorized treadmill as claimed in claim 9, wherein the sensor is a force sensor for sensing a force applied to the retaining member and transmitting an electrical signal to the controller; and wherein when the sensor senses the force applied to the retaining member, the controller determines that the endless belt is interfered by the object and stops rotation of the endless belt.

11. The motorized treadmill as claimed in claim 9, wherein when the controller determines that the endless belt is interfered by the object, the controller is operable to shut off power to the motor to stop operation of the motor for slowing down or stopping rotation of the endless belt.

12. The motorized treadmill as claimed in claim 9, further defines an unsafe zone between the base and the ground at the rear end of the base, wherein the retaining member is located in the unsafe zone; and wherein when the object is entrapped in the unsafe zone by rotation of the endless belt, the object will be retained by the retaining member and the controller is operable to stop rotation of the motor to slow down or stop rotation of the endless belt.

13. The motorized treadmill as claimed in claim 9, wherein the base has a front roller and a rear roller, the endless belt mounted around the front roller and the rear roller, the retaining member being located under the rear roller to prevent the object from being stuck under the rear roller.

14. The motorized treadmill as claimed in claim 9, wherein the endless belt defines an upper run at a top of the base and a lower run at a bottom of the base, the upper run of the endless belt configured for allowing the user to exercise thereon, and wherein the retaining member is located below the lower run of the endless belt at the rear end of the base to prevent the object from being stuck under the lower run of the endless belt.

15. A motorized treadmill, comprising:

a base rested on a ground, defining an unsafe zone between the base and the ground at a rear end of the base;

an endless belt mounted around the base for allowing a user to exercise thereon, and the unsafe zone being located below the endless belt;

a motor coupled to the endless belt for driving the endless belt to rotate;

a retaining mechanism having a retaining member mounted at the rear end of the base in the unsafe zone and a sensor coupled to the retaining member, the sensor configured to sense whether an object contacts the retaining member; and a controller in communication with the motor and the sensor of the retaining mechanism, the controller configured to determine whether rotation of the endless belt is interfered by the object;

wherein when the object is entrapped in the unsafe zone, the object will be retained by the retaining member, and wherein when the sensor detects that the object comes into contact with the retaining member, the controller determines that the endless belt is interfered by the object and stops rotation of the motor to slow down or stop rotation of the endless belt.

16. The motorized treadmill as claimed in claim 15, wherein the sensor is a force sensor for sensing a force applied to the retaining member and transmitting an electrical signal to the controller; and wherein when the sensor senses the force applied to the retaining member, the controller determines that the endless belt is interfered by the object and stops rotation of the endless belt.

17. The motorized treadmill as claimed in claim 15, wherein when the controller determines that the endless belt is interfered by the object, the controller is operable to shut off power to the motor to stop operation of the motor for slowing down or stopping rotation of the endless belt.

18. The motorized treadmill as claimed in claim 15, wherein the base has a front roller and a rear roller, the endless belt mounted around the front roller and the rear roller, the unsafe zone being located under the rear roller; and wherein when the object is entrapped in the/unsafe zone, the retaining member is operable to prevent the object from being stuck under the rear roller.

19. The motorized treadmill as claimed in claim 15, wherein the endless belt defines an upper run at a top of the base and a lower run at a bottom of the base, the upper run of the endless belt configured for allowing the user to exercise thereon, and wherein the retaining member is located below the lower run of the endless belt at the rear end of the base to prevent the object from being stuck under the lower run of the endless belt.

* * * * *